US011767147B2

(12) United States Patent
Affre De Saint Rome et al.

(10) Patent No.: US 11,767,147 B2
(45) Date of Patent: Sep. 26, 2023

(54) FOLDABLE PACKAGE PROVIDED WITH FOLDABLE PACKAGING MEANS AND LOCKING MEANS

(71) Applicant: PA.COTTE SA, Pully (CH)

(72) Inventors: Ronan Affre De Saint Rome, Oudon (FR); Yannik Frank, Nantes (FR)

(73) Assignee: PA. COTTE SA, Pully (CH)

( * ) Notice: Subject to any disclaimer, the term of this patent is extended or adjusted under 35 U.S.C. 154(b) by 0 days.

(21) Appl. No.: 18/017,499

(22) PCT Filed: Jul. 21, 2021

(86) PCT No.: PCT/EP2021/070453
§ 371 (c)(1),
(2) Date: Jan. 23, 2023

(87) PCT Pub. No.: WO2022/023149
PCT Pub. Date: Feb. 3, 2022

(65) Prior Publication Data

US 2023/0211918 A1 Jul. 6, 2023

(30) Foreign Application Priority Data

Jul. 27, 2020 (FR) ..... 2007901

(51) Int. Cl.
*B65D 6/18* (2006.01)
*B65D 55/02* (2006.01)

(52) U.S. Cl.
CPC ..... *B65D 11/1833* (2013.01); *B65D 55/02* (2013.01)

(58) Field of Classification Search
CPC . B65D 11/1833; B65D 11/184; B65D 11/186; B65D 11/18; B65D 55/02; B65D 43/164; B65D 43/163; B65D 43/16
(Continued)

(56) References Cited

U.S. PATENT DOCUMENTS 1,242,160 A * 10/1917 Eger et al. ..... B65D 11/1833 220/7
1,314,862 A * 9/1919 Eyler ..... B65D 11/1833 220/7

(Continued)

FOREIGN PATENT DOCUMENTS

| | | |
|---|---|---|
| FR | 739729 | 1/1933 |
| FR | 1032348 | 7/1953 |
| WO | 00/68099 | 11/2000 |

OTHER PUBLICATIONS

English translation of the Written Opinion as issued by the International Searching Authority, dated Jan. 31, 2023, for International Patent Application No. PCT/EP2021/070453; 9 pages.

(Continued)

*Primary Examiner* — Stephen J Castellano

(74) *Attorney, Agent, or Firm* — Faegre Drinker Biddle & Reath LLP

(57) ABSTRACT

A package including: a case having a bottom and a peripheral rim composed of panels and a lid. The package is collapsible between: a flat configuration, in which the panels and the lid extend substantially parallel to the bottom and a use configuration in which the case defines a storage volume, and in which the lid is movable between a storage volume access position and a storage volume closed position. The package includes a locking mechanism, first mechanism for locking the lid in its closed position, and second mechanism for locking the package in its flat configuration.

10 Claims, 9 Drawing Sheets

(58) Field of Classification Search
USPC ..... 220/6
See application file for complete search history.

(56) References Cited

U.S. PATENT DOCUMENTS

| | | | |
|---|---|---|---|
| 2,844,272 | A | 7/1958 | Mayer |
| 2018/0296016 | A1 | 10/2018 | Teoh |
| 2019/0300239 | A1 | 10/2019 | Reinhart |

OTHER PUBLICATIONS

International Search Report and Written Opinion as issued by the International Searching Authority, dated Sep. 17, 2021, for International Patent Application No. PCT/EP2021/070453; 18 pages.
English translation of International Search Report as issued by the International Searching Authority, dated Sep. 17, 2021, for International Patent Application No. PCT/EP2021/070453; 3 pages.

* cited by examiner

FOLDABLE PACKAGE PROVIDED WITH FOLDABLE PACKAGING MEANS AND LOCKING MEANS

CROSS-REFERENCE TO RELATED APPLICATIONS

The present application is a national stage entry of International (PCT) Patent Application Number PCT/EP2021/070453, filed Jul. 21, 2021, which claims priority to French Patent Application Number 2007901, filed Jul. 27, 2020, the complete disclosures of which are expressly incorporated herein by reference.

The field of the invention is that of logistics.

More specifically, the invention relates to a package, also called packing means, that is to say a container, for routing objects between two destinations.

To transport an object safely, packages such as boxes made of plastic materials and cardboards are known.

In general, the packages comprise a case having a bottom and a peripheral rim which together define a storage volume in which at least one object to be transported is housed.

The packages also comprise a lid that is movable relative to the case, or attached to the case, this lid being in particular able to adopt a closed position of the storage volume in which the lid closes off the storage volume of the case.

These packages are conventionally collapsible. They are thus mobile between a use configuration in which the case is formed and defines the storage volume, and a flat configuration in which the package is collapsed on itself and produces a smaller bulkiness.

More particularly, the peripheral rim comprises:

- a first panel;
- a second panel;
- a third panel opposite to the first panel;
- a fourth panel opposite to the second panel.

Each panel can thus adopt:

- a storage position in which it extends substantially parallel to the bottom;
- a use position in which it extends substantially perpendicular to the bottom.

To transport an object, a user picks up a package in the flat configuration. Indeed, most often, the panels of the peripheral rim are in their storage position, which implies that the package is in the flat configuration.

The user must then shape the case, that is to say define the storage volume by positioning each of the panels of the peripheral rim in its use position.

The user can then insert an object into the storage volume and position the lid in the closed position of the storage volume.

The lids of the packages are conventionally held in the closed position by means of adhesive strips.

Such adhesive strips prevent free passage of a lid from its closed position to a storage volume access position.

These adhesive strips are particularly easy to use, and their opening can be made universally by cutting or tearing.

This method for opening the packages provided with adhesive strips is nevertheless destructive. Indeed, the adhesive strip itself is not reusable, and it is highly likely that the package will be damaged under the effect of the cutting applied to the adhesive strip (cutting extending on the material constituting the package) or when tearing the adhesive strip, this tearing being able to remove part of the coating of the package with the adhesive strip.

More generally, the cardboard packages are generally only used for a single shipment or a particularly limited number of shipments.

These cardboard packages tend to degrade particularly quickly depending on the conditions under which these packages are handled, as well as the environmental conditions to which they may be subjected.

Consequently, given the volumes of cardboard used during logistic transport, it can be considered that the use of these cardboards is not ecological and particularly resource—intensive, even when taking into account the simple and easy nature to produce this type of package.

Lately, reusable package projects have emerged.

These reusable packages have the ability to be used many times before having to be recycled or repaired. In the end, although presenting a more complex and more expensive design or manufacture than that of cardboard packages, the ecological footprint of such reusable packages is better.

However, the use of reusable packages raises some problems.

Indeed, the problem relating to the storage of already used packages, that is to say received by a recipient, and to be stored before being reused or returned, is present.

In fact, when a user receives a package, he is not always able to directly return or reuse this package, and must put it aside. In its use configuration, a cardboard package presents a significant bulkiness. As a result, solutions aiming to reduce this bulkiness are necessary.

A cardboard package can be put back in its configuration, however practice has shown that the bulkiness of a package in its flat configuration and which has already been used, that is to say which has already been shaped at least once, is often greater than the one it presented in its flat configuration prior to its first use.

For example, it is observed that a package that has already been used and put back in its flat configuration may tend to return to a configuration in which it is in volume. Of course, these packages can be kept flattened in a forced manner, but this effect can still remain in the absence of an external stress.

The aim of the invention is in particular to overcome the drawbacks of the prior art.

More specifically, the aim of the invention is to propose a package that may be reused without showing any marks or that tends to show the least marks resulting from a previous use.

Another object of the invention is to provide such a package that can be easily stored between two uses.

These aims, as well as others which will appear subsequently, are achieved thanks to the invention which relates to a package comprising:

- a case having a bottom and a peripheral rim composed of panels;
- a lid;

the package being collapsible between:

- a flat configuration, in which the panels and the lid extend substantially parallel to the bottom;
- a use configuration in which the case defines a storage volume, and in which the lid is movable between a storage volume access position and a storage volume closed position, characterized in that the package comprises:
- a locking mechanism comprising at least one actuator movable between a locked position and an unlocked position;

first means for locking the lid in its closed position, the locking mechanism cooperating with the first locking means in the closed position of the lid;

second means for locking the package in its flat configuration, the locking mechanism cooperating with the second locking means in the flat configuration of the package;

the locking mechanism being inactive:

on the first locking means in the flat configuration of the package;

on the second locking means in the use configuration of the package.

The package according to the invention has characteristics tending to give it an ability to be reused.

Indeed, the locking means, by being directly integrated into the package, are thus reusable. More specifically, their passage from the unlocked position to the locked position is then not comparable to the use of an adhesive strip which deteriorates during such manipulation.

These package locking means according to the invention also have the ability to act in order to maintain the package in a flat configuration.

Consequently, it is only following a voluntary action of a user of the package that the latter can leave its flat configuration.

In this way, a previously used package can be moved again into its flat configuration, and locked in that position.

In its flat configuration and by being locked in this position, then the package maintains a bulkiness comparable to the one it produced when it was in its flat configuration and not used.

In addition, it is with certainty that the user can be assured that a plurality of packages in their flat position and locked in this position will not, over time, unfold and form a more significant bulkiness.

According to a preferred solution, the locking mechanism comprises:

an interface located on an outer face of the package;

two actuators, each actuator each including a maneuverable part located on the interface.

Thanks to this solution, the locking mechanism can be unlocked through an action performed on an outer face of the package.

Due to the implementation of two actuators, it is then unlikely that an unlocking is made accidentally.

The package thus has a more effective locking mechanism.

In this case, advantageously, the maneuverable parts are movable in the opposite direction relative to each other from their locked position to their unlocked position, and vice versa.

Thus, the movements of the maneuverable parts are reversed. For example, a first actuator must be slid to the left while the second actuator can be slid to the right.

According to another example, a first actuator must be slid upwards while a second actuator must be slid downwards.

This design allows further reinforcing the security of the unlocking mechanism. Indeed, in this case, it is only following an action performed voluntarily that the unlocking can take place, un accidental unlocking being unlikely.

The fact that a friction produced involuntarily on the package, for example by clothing, causes the unlocking of the two actuators resulting from a sliding of the actuators in the same direction, while being hooked, is in particular avoided.

Advantageously, the locking mechanism comprises a lock for blocking the actuator(s).

In this case, the locking mechanism can be blocked and it can be unblocked only with a key or a combination.

Such a lock ensures that the package can be opened or leave its flat configuration only by an authorized person.

According to one envisageable embodiment, the blocking lock can be electronic and thus be controlled by means of a command, for example sent by means of a computer server or a compatible electronic apparatus.

In such a situation, the package comprises on—board electronics allowing it to process such a command and to communicate remotely with a computer server and/or an electronic apparatus.

According to one advantageous characteristic, the locking mechanism comprises means for elastically returning the actuator(s) tending to bring them back from their unlocked position to their locked position.

The actuators thus tend to maintain their locked position.

Advantageously, the locking mechanism is integrated into a housing arranged in the case or in the lid.

This locking mechanism is thus not visible, or does not cause a bulkiness on the outside of the package or inside the package.

According to one preferred design:

the first locking means comprise at least one anchor point presented by the lid;

the second locking means comprise at least one anchor point presented by the bottom and/or at least one panel of the peripheral rim;

the locking mechanism comprising hooking members for each of the anchor points, the hooking members being driven in mobility by the actuator(s).

This design provides a particularly reliable locking mechanism.

According to one preferred solution, in the use configuration of the package, the or each anchor point of the second locking means is retracted into a cavity arranged in the case or in the lid.

In this way, the anchor points of the second locking means do not produce any bulkiness in the package in its use configuration. In other words, these anchor points do not form a protrusion inside the storage volume defined by the case in the use configuration of the package.

According to one preferred embodiment, in the flat configuration of the package:

one of the panels, the bottom and the lid, called first framing element and another of the panels, the bottom and the lid, called second framing element;

at least partially frames the rest of the panels, the bottom and the lid, and the locking mechanism is located on the first framing element, and the or each anchor point of the second locking means is located on the second framing element.

In this way, the locking mechanism and the second locking means allow holding in position, one with respect to the other, the first framing element and the second framing element, so as to maintain the rest of the panels, the bottom and the lid held by the framing elements.

According to one variant, the peripheral rim comprises four panels movably mounted in rotation on the bottom, including:

a first panel;

a second panel opposite to the first panel;

a third panel;

a fourth panel opposite to the third panel;

and in that the flat configuration of the package:

the third panel and the fourth panel are folded over the bottom;

the first panel is folded over the third panel, and the fourth panel;

the second panel is folded back in the extension of the bottom;

the lid is positioned on the third panel, the fourth panel and the second panel, and in the extension of the first panel.

This variant offers a space—saving flat configuration of the package.

Advantageously, the third panel and the fourth panel are folded over the bottom by retracting into the bottom.

According to one advantageous characteristic, the lid is movably mounted in rotation on the second panel.

Other characteristics and advantages of the invention will appear more clearly upon reading the following description of one preferred embodiment of the invention, given by way of illustrative and non—limiting example, and the appended drawings, among which:

Figure 1:
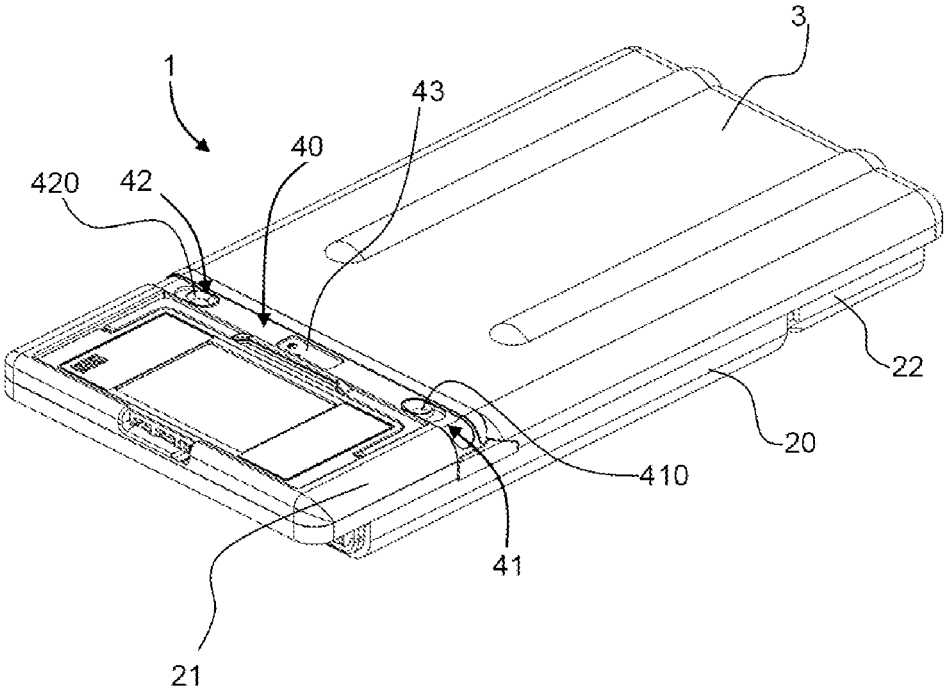
FIG. 1 is a schematic representation according to a top perspective view of a package according to the invention, in a flat configuration.

With reference to FIGS. 1 to 7, a package 1 according to the invention is described below.

The package 1 comprises:

a case 2;

a lid 3.

Referring to FIGS. 1, 2, 3, 4 and 6, the case 2 comprises a bottom 20 and a peripheral rim.

The peripheral rim is in particular composed of panels 21, 22, 23, 24.

More specifically, the peripheral rim comprises four panels including:

a first panel 21;

a second panel 22;

a third panel 23;

a fourth panel 24.

According to the present embodiment, these four panels 21, 22, 23, 24 are movably mounted in rotation on the bottom 20, and the lid 3 is movably mounted in rotation on the second panel 22.

According to another envisageable embodiment, the lid 3 could be removable and must be positioned on the case 2 when the storage volume is to be closed.

According to one principle of the invention, the package 1 is collapsible.

In particular, this package is collapsible between:

a flat configuration (FIGS. 1 and 6), in which the panels 21, 22, 23, 24 and the lid 3 extend substantially parallel to the bottom 20, and a use configuration (FIG. 2) in which the case 2 defines a storage volume.

The flat configuration corresponds in particular to a storage configuration of the package 1.

In the use configuration, the lid 3 is movable between a storage volume access position and a storage volume closed position.

Figure 2:
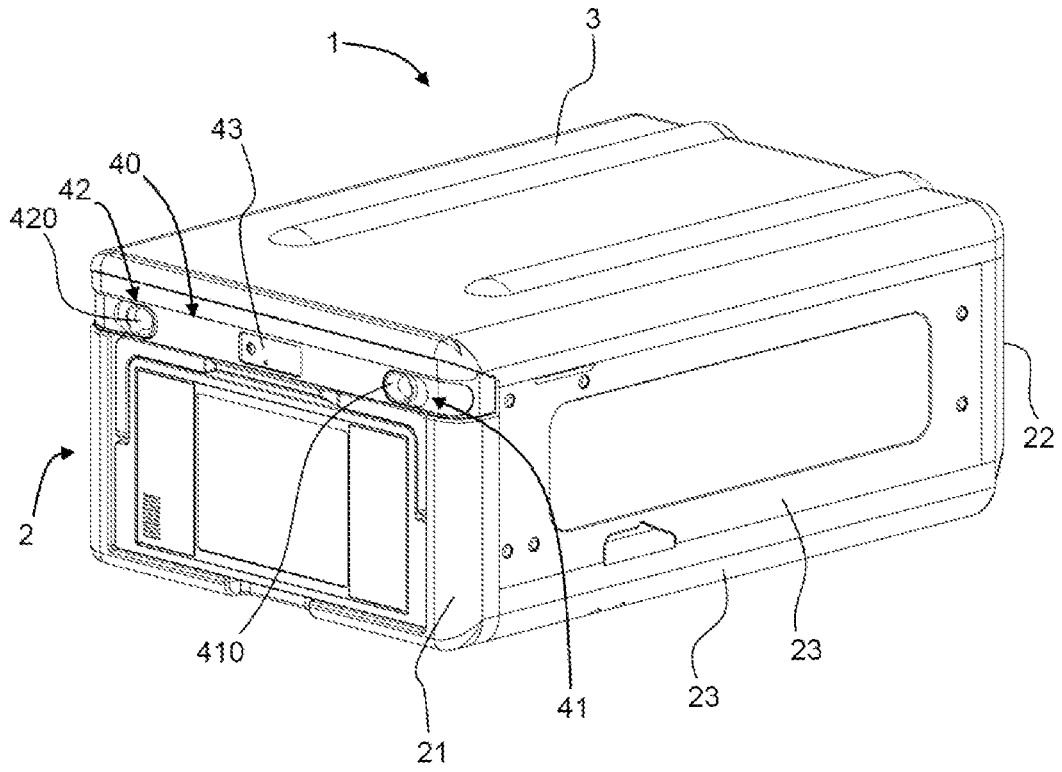
FIG. 2 is a schematic representation according to a top perspective view of the package according to the invention, according to a use configuration in which a case of the package is formed and defines a storage volume closed by a lid.

As illustrated in FIG. 2, the package 1 is in its use configuration and the lid 3 is in its storage volume closed position.

Figure 3:
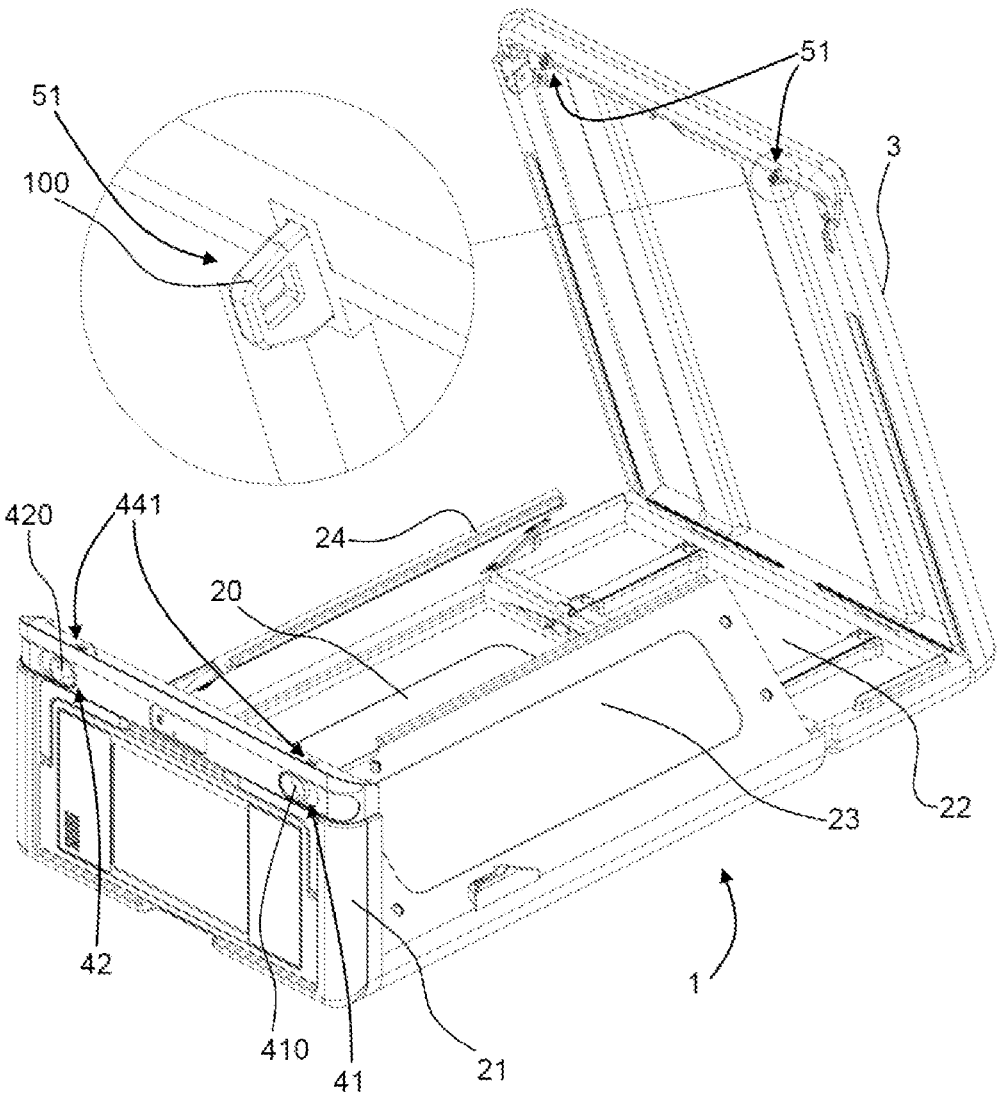
FIG. 3 is a schematic representation according to a top perspective view of the package according to the invention, in an intermediate state between the flat configuration and the use configuration, with a detail medallion illustrating an anchor point presented by the lid of the package.
Figure 4:
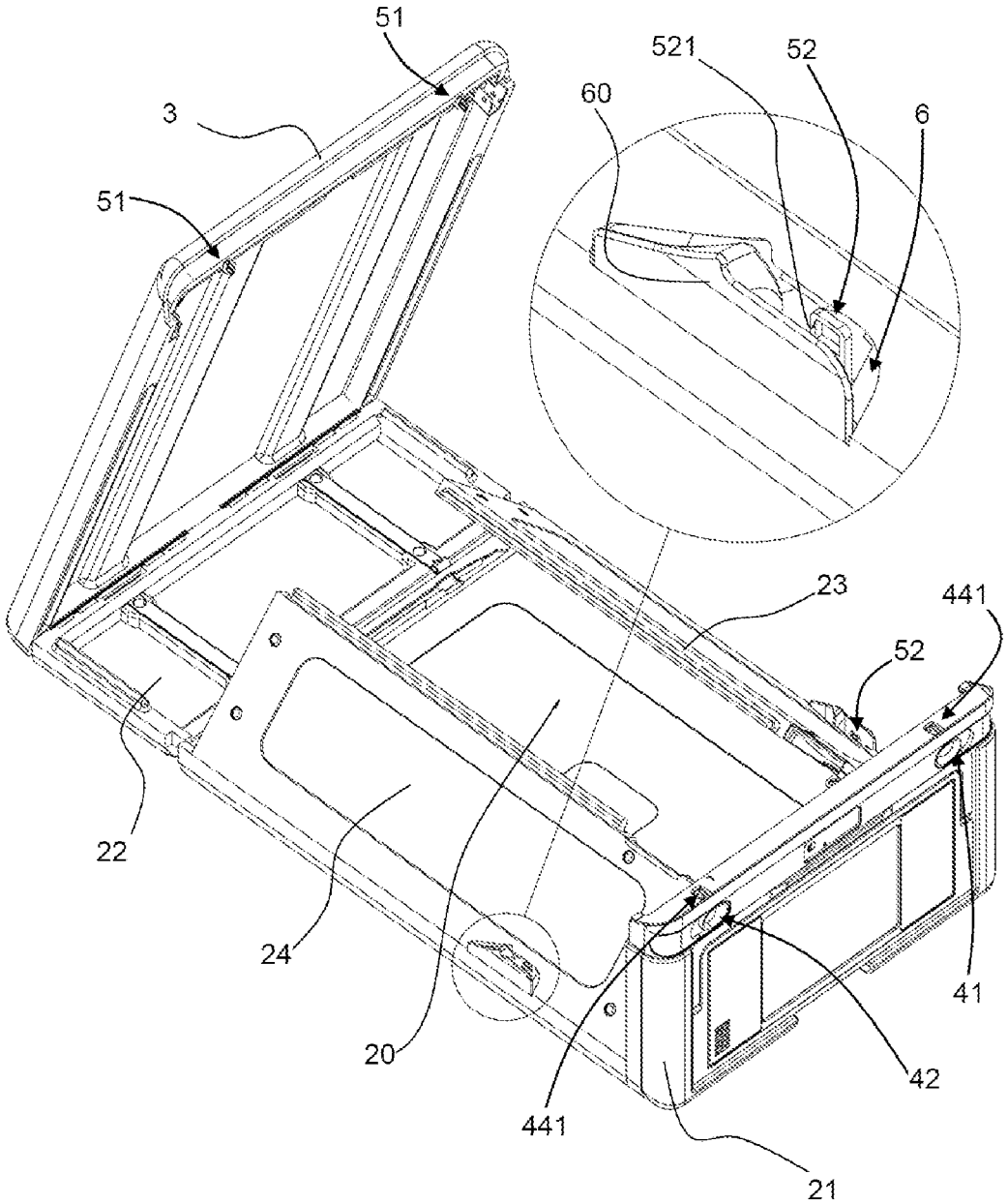
FIG. 4 is a schematic representation according to a top perspective view, according to another angle of view relative to FIG. 3, and comprising a detail medallion illustrating an anchor point presented by a bottom of the package.

In the use configuration, and as illustrated in FIGS. 3 and 4, the second panel 22 is opposite to the first panel 21, and the fourth panel 24 is opposite to the third panel 23. The panels 21, 22, 23, 24 are then deployed.

In their deployed position, the first panel 21, the second panel 22, the third panel 23 and the fourth panel 24 extend substantially perpendicular to the bottom 20 and define a band. The peripheral rim is then continuous and delimits with the bottom 20 the storage volume.

As illustrated in the figures, in the flat configuration of the package 1:

the third panel 23 and the fourth panel are folded over the bottom 20;

the first panel 21 is folded over the third panel 23, and the fourth panel 24;

the second panel 22 is folded in the extension of the bottom 20;

the lid 3 is positioned on the third panel 23, the fourth panel 24 and the second panel 22, as well as in the extension of the first panel 21.

Still according to the present embodiment, the bottom 20 itself defines a cavity open to the storage volume. In the flat configuration of the package 1, the third panel 23 and the fourth panel 24 are folded over the bottom 20 by being retracted inside the cavity of the bottom 20.

In this way, when the third panel 23 and the fourth panel 24 are folded over the bottom 20, they do not protrude above the bottom 20.

Consequently, in the flat configuration of the package 1, the latter has a total height resulting only from the thickness of the bottom 20 and the thickness of the lid 3.

With reference to FIGS. 1 to 7, and according to the principle of the invention, the package 1 also comprises:

a locking mechanism;

first means for locking 51 the lid 3 in its closed position;

second means for locking 52 the package 1 in its flat configuration.

The locking mechanism comprises at least one actuator 41, 42, which is movable between a locked position and an unlocked position.

This locking mechanism cooperates with the first locking means 51 in the closed position of the lid 3. In addition, the locking mechanism cooperates with the second locking means 52 in the flat configuration of the package 1.

The locking mechanism is inactive on the first locking means 51 in the flat configuration of the package 1 and on the second locking means 52 in the use configuration of the package 1.

In other words, in the flat configuration of the package 1, the locking mechanism cooperates with the second means for locking 52 the package 1 to maintain the package in its flat configuration, but does not cooperate (inactive state) with the first locking means 41.

On the other hand, in the use configuration of the package 1, the locking mechanism and the first locking means 51 cooperate together to lock the lid 3 in its closed position, while the locking mechanism does not cooperate (inactive state) with the first locking means 51.

According to the present embodiment, the locking mechanism comprises:

an interface 40 located on an outer face of the package 1;

two actuators 41, 42 including a first actuator 41 and a second actuator 42;

a lock 43;

means for elastically returning the actuators 41, 42.

Figure 6:
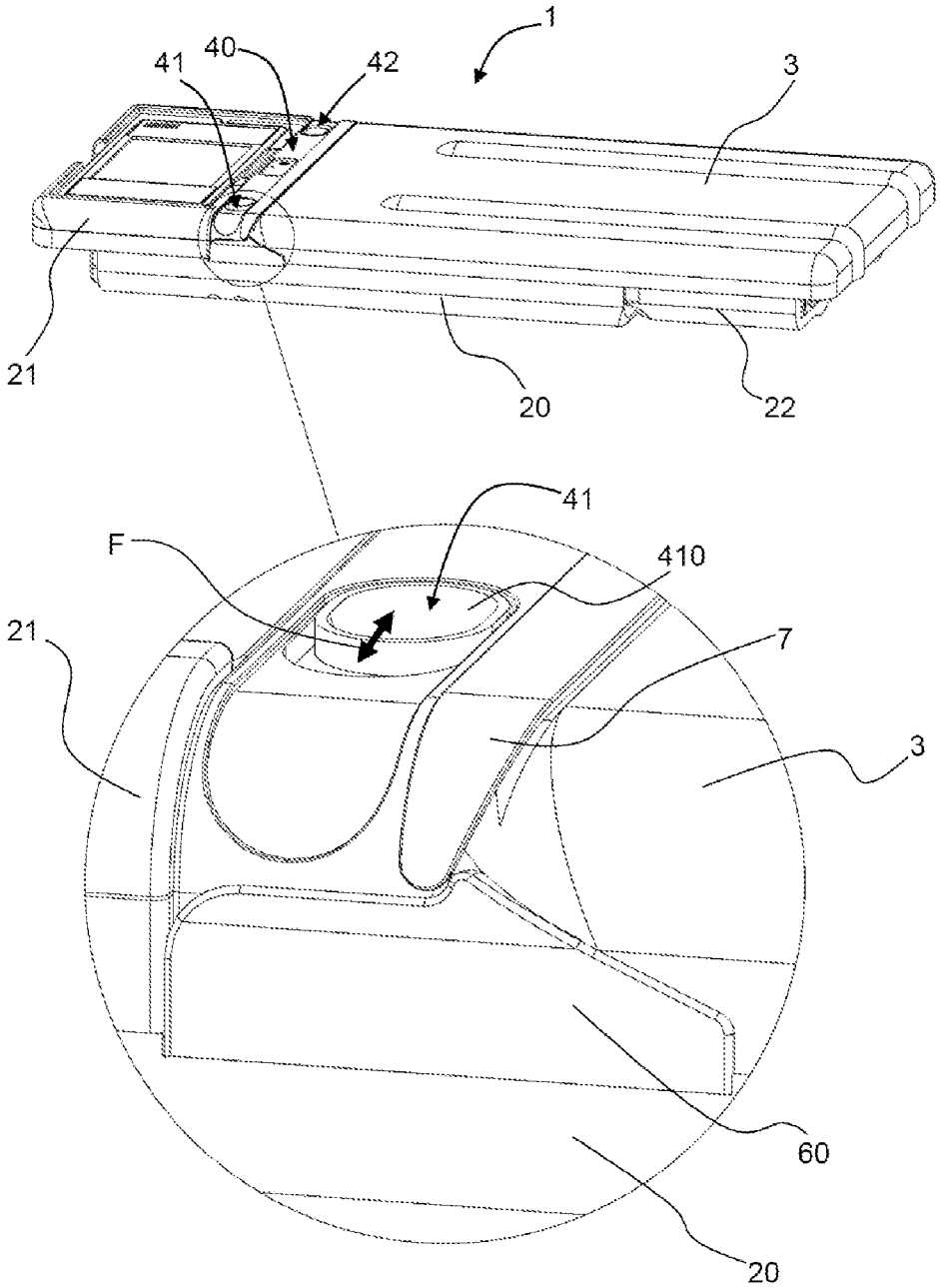
FIG. 6 is a schematic representation according to a top side perspective view of the package 1 in the flat configuration, with a detail medallion illustrating in particular a junction between the bottom, the lid and a panel of the case of the package.

The first actuator 41 and the second actuator 42 each include a maneuverable part 410, 420 located on the interface 40. As illustrated in FIG. 6 and in particular by the detail medallion, the actuators 41, 42 have a maneuverable part 410, 420 which is sliding (arrow F).

More specifically, the first actuator 41 illustrated in FIG. 6 is in a locked position. The maneuverable part 410 of this actuator 41 can be slid towards the outside of the package 1 to move it into its unlocked position.

According to the present embodiment, the maneuverable parts 410, 420 are movable in an opposite direction relative to each other from their locked position to their unlocked position.

Conversely, it is understood that these maneuverable parts 410, 420 are movable in the same direction relative to each other from their unlocked position to their locked position.

In other words, the movements of the maneuverable parts 410, 420 are reversed so that, when the first actuator 41 must be slid to the right, then the second actuator 42 must be slid to the left, thereby allowing the unlocking of the actuators.

The means for elastically returning the actuators 41, 42 tend to bring back these actuators 41, 42 from their unlocked position to their locked position.

These elastic return means are for example formed by springs.

In this way, the actuators 41, 42 always tend to adopt their locked position.

Referring to FIG. 2, the lock 43 allows blocking the actuators 41, 42.

A compatible key allows blocking and unblocking the actuators 41, 42.

For example, this lock may be of the type implemented in suitcases or luggages locking systems designed to facilitate customs control during travel.

Figure 5:
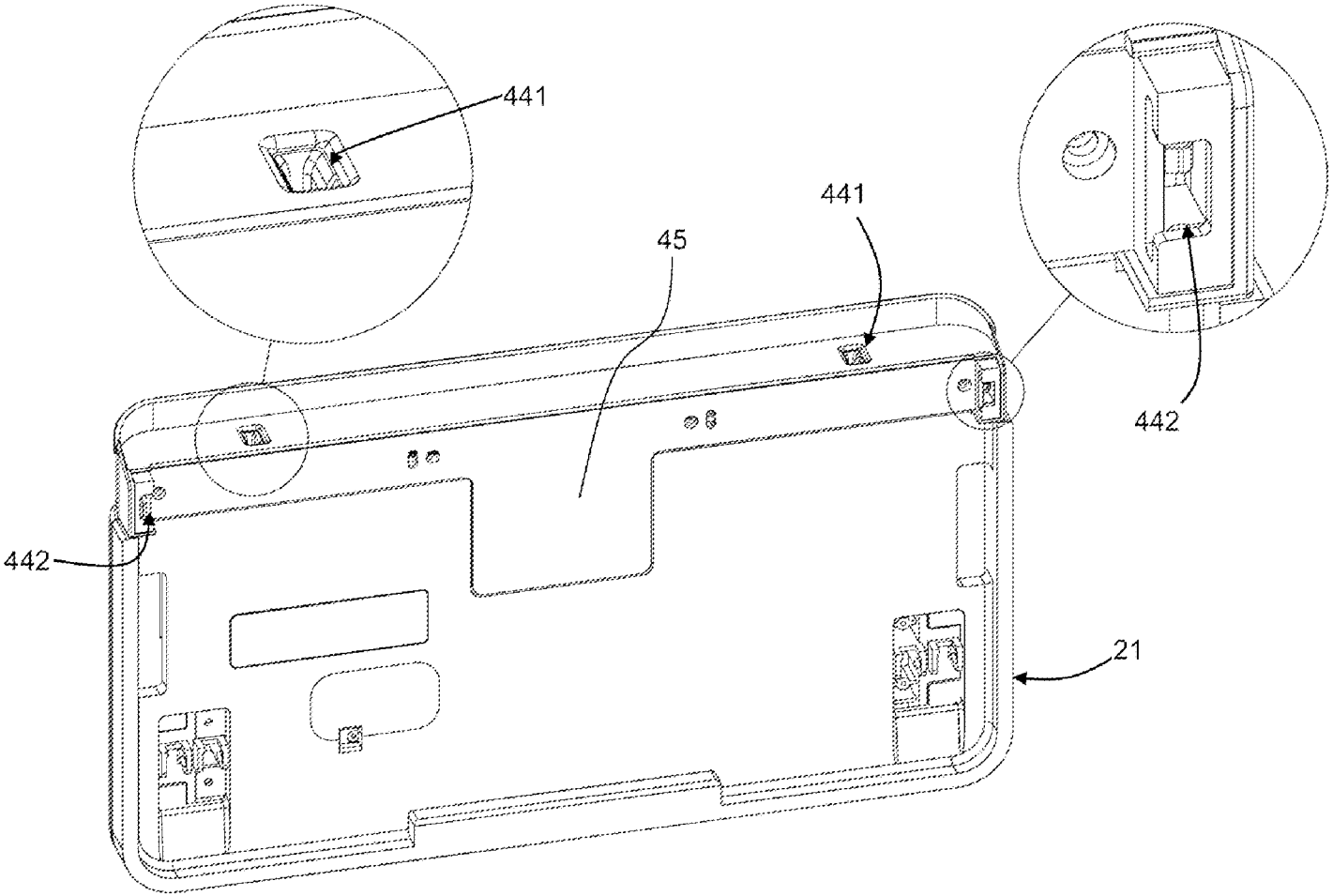
FIG. 5 is a schematic representation according to a top perspective view of a rear face of a panel of the case of the package, the panel incorporating a mechanism for locking the package.

As illustrated in FIG. 5 and FIGS. 1 and 2, the locking mechanism is integrated into a housing arranged in the case 2 and the lid 3.

More specifically, the locking mechanism is integrated within a casing 45 taking place in the housing which is arranged in the first panel 21.

The interface 40 of the locking mechanism is thus located on the first panel 21.

Referring to FIGS. 3 and 4, the first locking means 51 and the second locking means 52 each comprise two anchor points 511, 521.

The anchor points 511 of the first locking means 51 are presented by the lid 3, and the anchor points 521 of the second locking means 52 are presented by the bottom 20. According to the present embodiment, the anchor points 521 of the second locking means 52 are presented by the bottom 20. As a variant, the anchor points 521 of the second locking means 52 are presented by at least one panel 21, 22, 24 of the peripheral rim.

These anchor points 511, 521 are in particular formed by protrusions each having a hook element which is more particularly a hole passing through the protrusion transversely.

Referring to FIGS. 5, 7, 8 and 9, the locking mechanism for its part comprises hooking members 441, 442 for each of the anchor points 511, 521.

These hooking members 441, 442 are driven in mobility by the actuators 41, 42.

In particular, these hooking members 441, 442 are located, at least partially, in housings for receiving the anchor points 511, 521.

Figure 7:
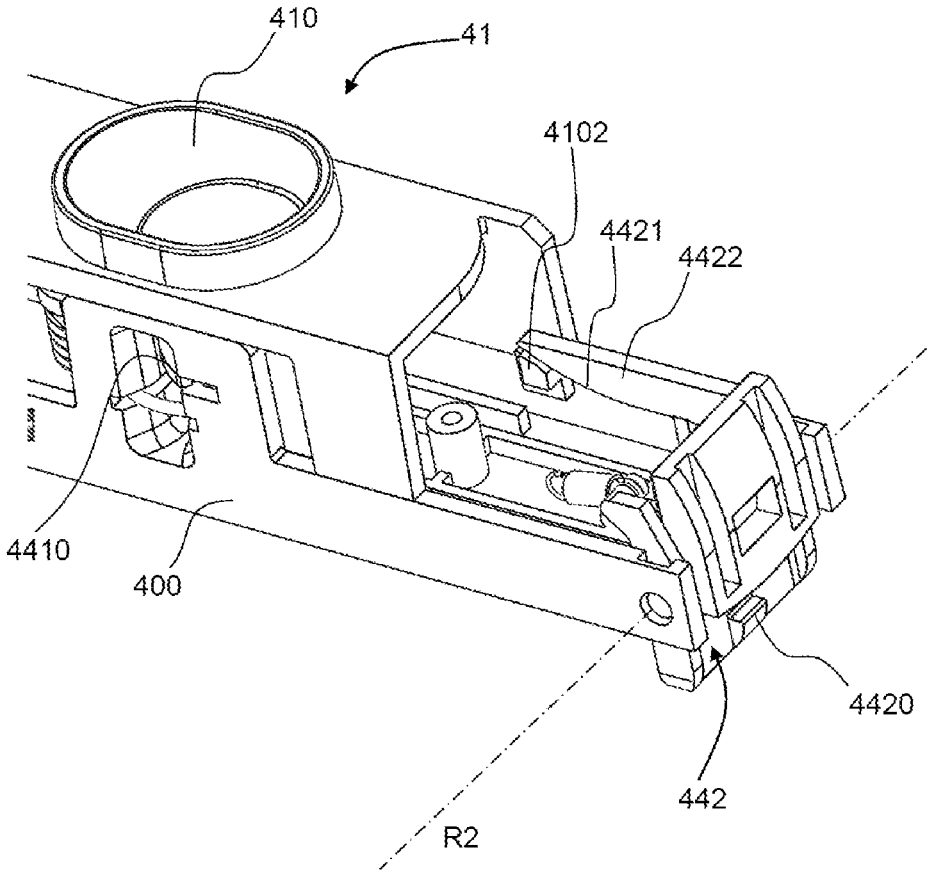
FIG. 7 is a schematic representation according to a perspective view illustrating an actuator in a locked position.
Figure 8:
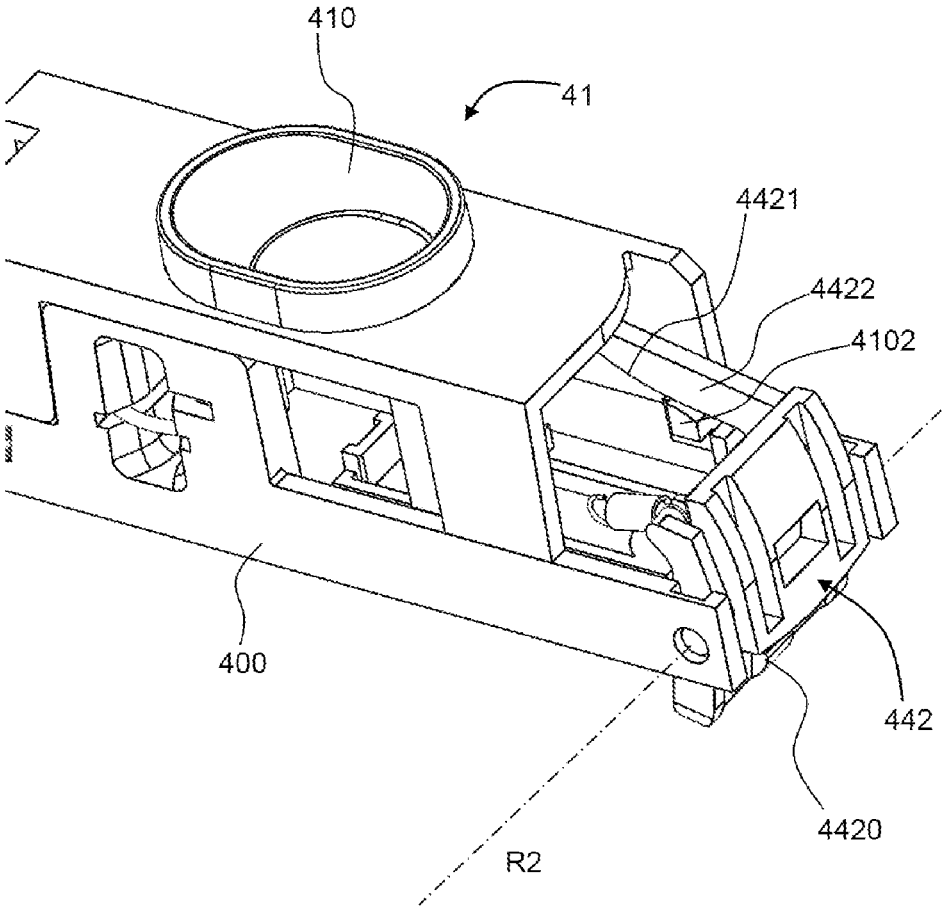
FIG. 8 is a schematic representation according to a perspective view similar to FIG. 7 and illustrating the actuator in an unlocked position.
Figure 9:
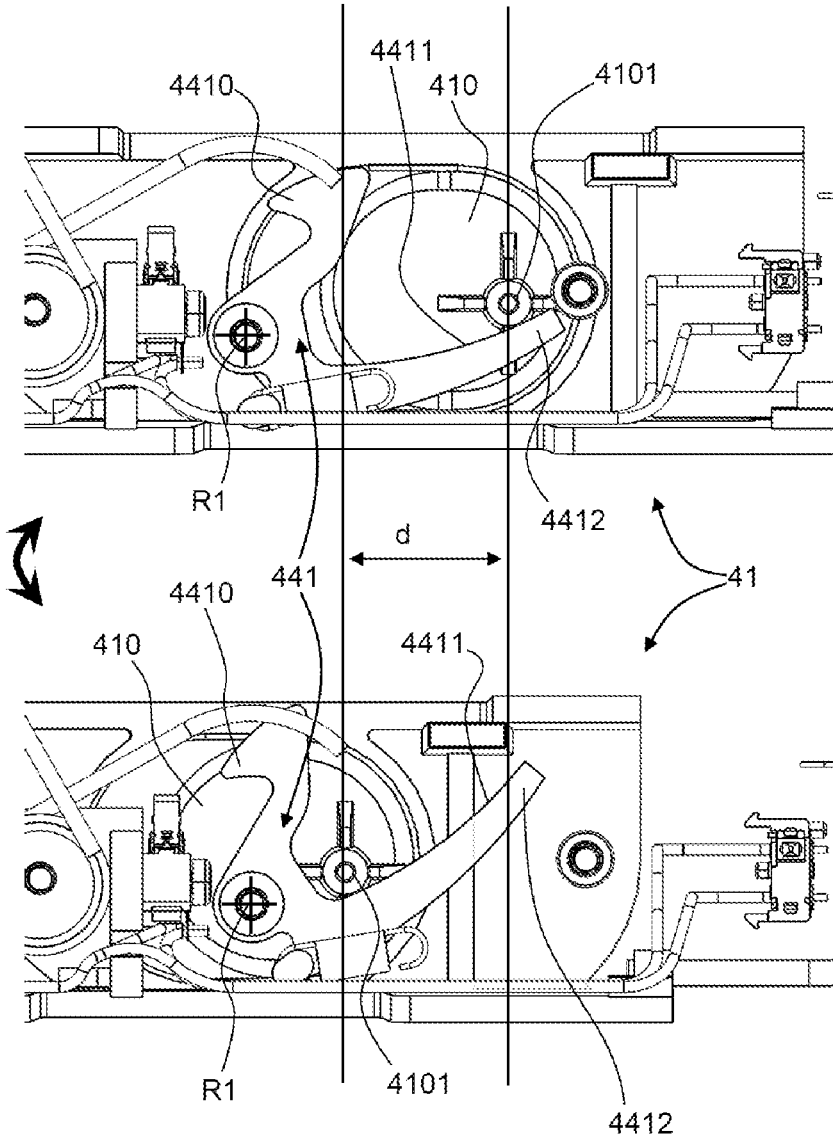
FIG. 9 is a schematic representation illustrating the unlocked position and the locked position of the actuator.

FIGS. 7 to 9 specifically illustrate the first actuator 41. The structure of this first actuator 41 is identical to that of the second actuator 42, while being however adapted to the position of this second actuator 42. Consequently, the following description of the first actuator 41 is also applicable to the second actuator 42.

According to the embodiment illustrated in FIGS. 7 to 9, each hooking member 441, 442 includes a bolt 4410, 4420 designed to cooperate with the hook element presented by the protrusion of the anchor point which is intended to be inserted into the receiving housing corresponding to the ad hoc hooking member.

According to one envisageable embodiment, each hooking member 441, 442 can for example be secured in translation to one of the actuators 41, 42.

According to the embodiment illustrated in FIGS. 7 to 9, the hooking members 441, 442 are movable in rotation, and driven in rotation under the effect of a sliding of the maneuverable part 410 of the actuator 41.

More specifically, the maneuverable part 410 is movable in translation on a base 400.

As illustrated more specifically in FIG. 9, the hooking member 441 is movable in rotation about a first axis R1 carried by the base 400. This hooking member 441 also comprises a guide surface 4411 carried by an arm 4412, and its bolt 4410 is formed by a hook.

The maneuverable part 410 has a cam 4101 formed by a cylindrical element, or by a roller. This cam 4101 is complementary to the guide surface 4411 as illustrated in FIG. 9.

According to the present embodiment, a means for elastically returning the hooking member 441 allows returning it to the locked position.

Thus, a displacement "d" of the maneuverable part 410, and thus of the cam 4101, allows driving in rotation the hooking member 441.

Similarly and as illustrated in FIGS. 7 and 8, the hooking member 442 is movable in rotation about a second axis R2 carried by the base 400. This hooking member 442 also comprises a guide surface 4421 carried by an arm 4422, and its bolt 4420 is formed by a notch.

The maneuverable part 410 has a cam 4102 formed by a pin. This cam 4102 is complementary to the guide surface 4421 as illustrated in FIGS. 7 and 8.

According to the present embodiment, a means for elastically returning the hooking member 442 allows returning it to the locked position.

Thus, a displacement "d" of the maneuverable part 410, and thus of the cam 4102, allows driving in rotation the hooking member 442.

Referring to FIGS. 7 and 9, each bolt may also have a bevel, or a suitable curved surface, allowing, during the insertion of the anchor point into the receiving housing, pushing back the bolt, and allowing the automatic locking of this anchor member once it is sufficiently inserted into the receiving housing.

Indeed, once the anchor member is completely inserted into the receiving housing, then the bolt can extend again, under the effect of the elastic return means, into the receiving housing by cooperating with the hook element of the anchor point.

As illustrated in FIGS. 2, 4 and 6, the anchor points 521 of the second locking means 52 are retracted into cavities 6 arranged in the case 2. These anchor points then do not produce any bulkiness inside the package 1 when it is in its use configuration.

More specifically, the anchor points 521 of the second locking means 52 extend from the bottom 20, in the alignment of the third panel 23 or the fourth panel 24 in their deployed position. The cavities 6 are thus presented by the third panel 23 and the fourth panel 24.

To close the cavities 6, the package has covers 60 for each cavity 6. These covers 60 are intended to protect the anchor points 521 of the second locking means 52. The covers 60 are secured to the bottom 20 and extend in the extension of an external face of the third panel 23 and fourth panel 24 in their deployed position.

As explained previously, the cooperation of the locking mechanism with the second locking means 52 allows maintaining the package 1 in its flat configuration.

Indeed, in the flat configuration of the package 1:

one of the panels 21, 22, 23, 24, the bottom 20 and the lid 3, called first framing element, and another of the panels 21, 22, 23, 24, bottom 20, and lid 3, called second framing element;

at least partially frame the rest of the panels 21, 22, 23, 24, the bottom 20 and the lid 3.

In addition, as explained above, the locking mechanism is located on the first panel 21 which thus forms the first framing element, and each anchor point 521 of the second locking means 52 is located on the bottom 20 which thus forms the second framing element.

As a reminder, in the flat configuration of the package 1, the third panel 23 and the fourth panel are folded over the bottom 20, and the first panel 21 is folded over the third panel 23 as well as the fourth panel 24. The cooperation of the locking mechanism located on the first panel 21 with the second locking means 52 thus allows holding the third panel 23 and the fourth panel 24 in the folded position, the first panel 21 then being secured to the bottom 20.

In addition, the second panel 22 is then folded in the extension of the bottom 20, and the lid 3 is positioned on the third panel 23, the fourth panel 24 and the second panel 22, as well as in the extension of the first panel 21.

According to the present embodiment and as illustrated in FIG. 6, the first panel 21 comprises a cap 7 partially overlapping a front edge of the lid 3 in the flat configuration of the package 1.

Consequently, the cooperation of the locking mechanism located on the first panel 21 with the second locking means 52 also allows, by means of the cap 7, preventing the lid 3 and the second panel 22 from leaving their position without the will of a user to format the case 2.

An example of use of the package 1 is described below, with reference to FIGS. 1 to 6.

From the flat configuration of the package 1, a user can position his hands on either side of the interface 40 and slide the actuators 41, 42 from their locked position to their unlocked position, by exerting a pressure on the maneuverable parts 410, 420.

From then on, and by maintaining the pressure, the locking mechanism is unlocked.

The user can directly tilt the first panel 21 into its deployed position.

The lid 3 is then released from the holding exerted by the cap 7.

The user can then tilt the lid 3 backwards relative to the second panel 22.

The third panel 23 and fourth panel 24 are then also released and the user can deploy them. In one variant not represented, the deployment of the third panel 23 and the fourth panel 24 is automatic using means for returning said third panel 23 and fourth panel 24 to the deployed position.

The user then has to tilt the second panel 22 forwards, in its deployed position, then to fold the lid 3 over the case 2 formed.

The passage of the lid 3 in its storage volume closed position directly triggers the locking of the lid 3.

Indeed, by moving in this position, the first locking means 51 are directly anchored in the housings for receiving the hooking members 441.

The package 1 is then in its use configuration with the lid 3 locked in its closed position.

The folding of the package 1 is carried out inversely to the way of shaping the package 1 previously described.

The invention claimed is:

1. A package comprising:

a case having a bottom and a peripheral rim composed of panels;

a lid;

the package being collapsible between:

a flat configuration, in which the panels and the lid extend substantially parallel to the bottom;

a use configuration in which the case defines a storage volume, and in which the lid is movable between a storage volume access position and a storage volume closed position, the package comprising:

a locking mechanism;

first means for locking the lid in its closed position, the locking mechanism cooperating with the first locking means in the closed position of the lid, the first locking means comprising at least one anchor point presented by the lid;

second means for locking the package in its flat configuration, the locking mechanism cooperating with the second locking means in the flat configuration of the package, the second locking means comprising at least one anchor point presented by the bottom and/or at least one panel of the peripheral rim;

wherein the locking mechanism comprises:

at least one actuator movable between a locked position and an unlocked position;

hooking members for each of the anchor points, the hooking members being driven in mobility by the actuator(s);

the locking mechanism being inactive:

on the first locking means in the flat configuration of the package;

on the second locking means in the use configuration of the package.

2. The package according to claim 1, wherein the locking mechanism comprises:

an interface located on an outer face of the package;

two actuators, each actuator each including a maneuverable part located on the interface.

3. The package according to claim 2, wherein the maneuverable parts are movable in opposite directions relative to each other from their locked position to their unlocked position, and vice versa.

4. The package according to claim 2, wherein the locking mechanism comprises a lock for blocking the actuator(s).

5. The package according to claim 1, wherein the locking mechanism comprises means for elastically returning the actuator(s) tending to bring them back from their unlocked position to their locked position.

6. The package according to claim 1, wherein the locking mechanism is integrated into a housing arranged in the case or in the lid.

7. The package according to claim 1, wherein, in the use configuration of the package, the or each anchor point of the second locking means is retracted into a cavity arranged in the case or in the lid.

8. The package according to claim 1, wherein, in the flat configuration of the package:

one of the panels, the bottom and the lid, called first framing element, and another of the panels, the bottom and the lid, called second framing element;

at least partially frame the rest of the panels, the bottom and the lid, and in that the locking mechanism is located on the first framing element, and the or each anchor point of the second locking means is located on the second framing element.

9. The package according to claim 1, wherein the peripheral rim comprises four panels movably mounted in rotation on the bottom, including:

a first panel;

a second panel opposite to the first panel;

a third panel;

a fourth panel opposite to the third panel;

and wherein, in the flat configuration of the package:

the third panel and the fourth panel are folded over the bottom;

the first panel is folded over the third panel, and the fourth panel;

the second panel is folded back in the extension of the bottom;

the lid is positioned on the third panel, the fourth panel, and the second panel, and in the extension of the first panel.

10. The package according to claim 9, wherein the lid is movably mounted in rotation on the second panel.

* * * * *